United States Patent [19]

Chavarria

[11] Patent Number: 4,689,884

[45] Date of Patent: Sep. 1, 1987

[54] V-SNIP SCISSORS

[76] Inventor: Randy Chavarria, Lexington Ave., New York, N.Y. 10016

[21] Appl. No.: 867,765

[22] Filed: May 28, 1986

[51] Int. Cl.[4] ..... B26B 13/00

[52] U.S. Cl. ..... 30/229; 30/194

[58] Field of Search ..... 30/194, 229, 231, 233

[56] References Cited

U.S. PATENT DOCUMENTS

| | | | |
|---|---|---|---|
| 591,999 | 10/1897 | Carter | 30/229 X |
| 2,603,864 | 7/1952 | Neola | 30/229 |
| 3,014,275 | 12/1961 | Siravo | 30/229 |
| 4,327,487 | 5/1982 | Brownell | 30/229 X |
| 4,610,086 | 9/1986 | Mastroianni | 30/229 X |

*Primary Examiner*—E. R. Kazenske
*Assistant Examiner*—Michael D. Folkerts
*Attorney, Agent, or Firm*—M. N. Meller

[57] ABSTRACT

Scissors for cutting a V shape have two parts which are pivotably coupled. The first part has a V-shaped cutting block with two cutting edges which meet at an apex. The second part has a pair of cutting blades with cutting edges which cooperate with the cutting edges of the cutting block during relative rotation of the parts. The cutting blades are arranged such that the point at which the cutting edges of the cutting block meet engages the cutting edges of the cutting blades at different angles in the relative rotation of the two parts.

7 Claims, 7 Drawing Figures

V-SNIP SCISSORS

FIELD OF THE INVENTION

The invention relates to scissors specially designed for cutting a V shape in soft fabric or human hair.

BACKGROUND OF THE INVENTION

Scissors for cutting a shape other than a straight line are disclosed in U.S. Pat. Nos. 176,553, 491,078 and 2,800,715. The first two references disclose shears which are capable of cutting a right angle. The last of the three references discloses pinking shears for providing a zig-zag cutting edge in clothing or the like. Also, French Patent No. 1,160,151 discloses scissors for cutting a wave-like edge.

None of the above-discussed references discloses scissors suitable for snipping hair in a V shape.

SUMMARY OF THE INVENTION

The object of the invention is to provide scissors capable of cutting a V shape in a single snip.

This object is achieved by providing scissors which have a V-shaped cutting block and a pair of cooperating cutting blades. The cutting block is supported by a crosspiece connected to one arm of the scissors handle. The cutting blades are supported by a second crosspiece connected to the other arm of the scissors handle. The cutting block, first crosspiece and first arm form elements in a one-piece part. Also, the cutting blades, second crosspiece and second arm form elements in a second one-piece part. The cutting edges of the cutting blades are asymmetrically arranged relative to the lower planar surface of the cutting block, which planar surface has cutting edges which cooperate with the cutting edges of the cutting blades during the snipping operation. The portion of the cutting edge of the first cutting blade member which engages the apex of the cutting block lies directly above the portion of the cutting edge of the second cutting blade which engages the apex, a notch in the first cutting blade being provided, across and through which the second cutting blade extends.

BRIEF DESCRIPTION OF THE DRAWINGS

The preferred embodiment of the invention will be described in detail with reference to the following drawings.

DETAILED DESCRIPTION OF THE PREFERRED EMBODIMENT

Figure 1:
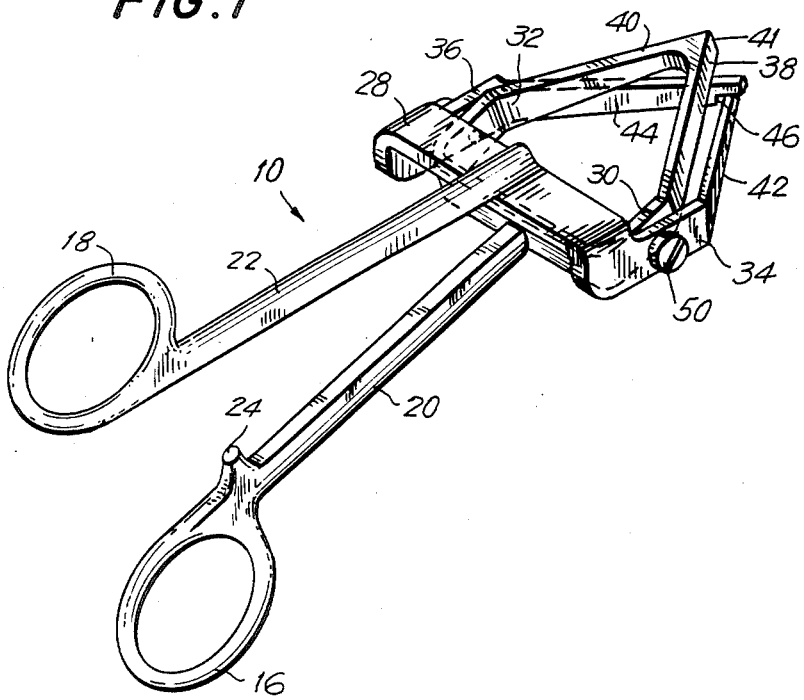
FIG. 1 is a perspective view of the V-snip scissors in the open position in accordance with the preferred embodiment.
Figure 3:
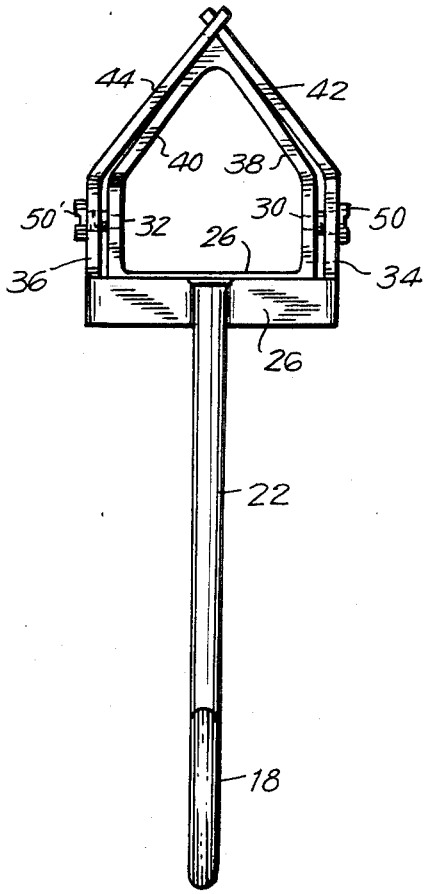
FIG. 3 is a top view of the scissors of FIG. 1 in the closed position.
Figure 5:
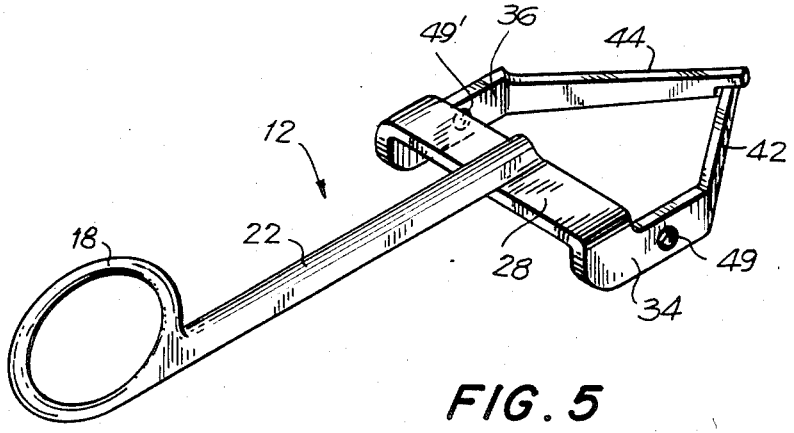
FIG. 5 is a perspective view of the cutting blade portion of the scissors of FIG. 1.
Figure 4:
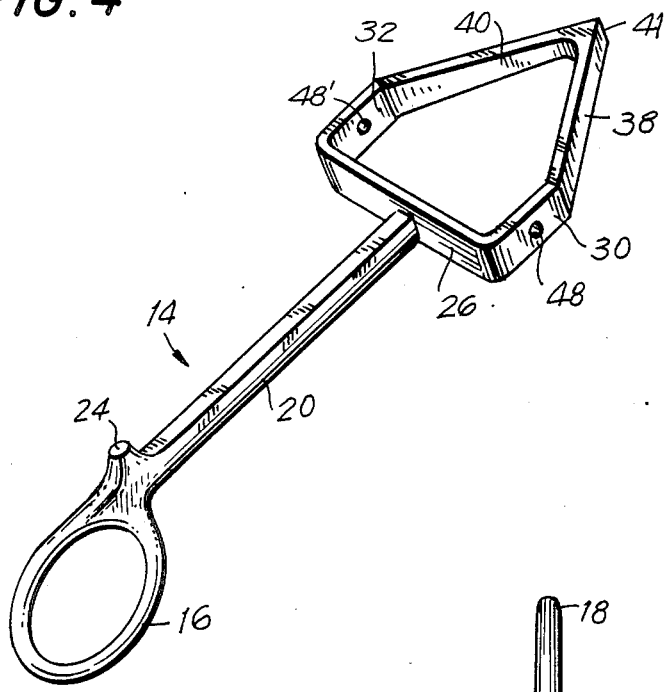
FIG. 4 is a perspective view of the cutting block portion of the scissors of FIG. 1.

The scissors 10 in accordance with the preferred embodiment has two parts 12 and 14, which are depicted separately in FIGS. 4 and 5. Parts 12 and 14 are pivotably coupled by rivets 50, 50', which can be seen most clearly in FIG. 3. A perspective view of the assembled scissors is shown in FIG. 1.

Figure 2:
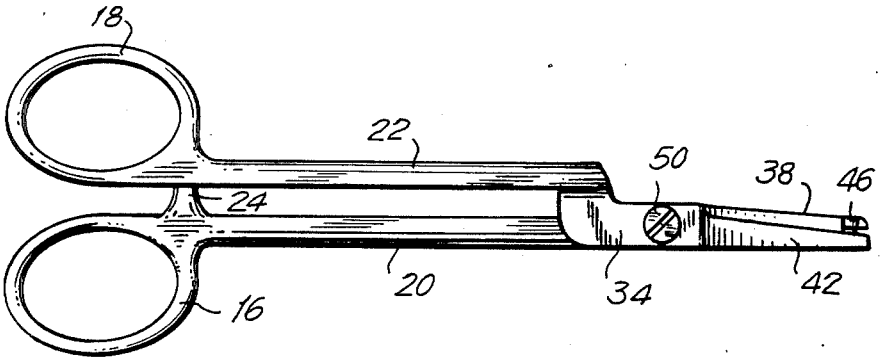
FIG. 2 is a side view of the scissors of FIG. 1 in the closed position.

Part 14, as shown in FIG. 4, comprises a ring 16 having a finger hole, ring 16 being connected to arm 20, which arm is in turn connected to crosspiece 26. A stopper 24 is integrally formed on arm 20 and is positioned to contact the arm 22 of part 12 when rings 16 and 18 are squeezed together by the user (as shown in FIG. 2). The crosspiece 26 extends in a direction transverse to arm 20, and is respectively connected at its ends to side members 30 and 32. The ends of side members 30 and 32 remote from crosspiece 26 are in turn connected to cutting block members 38 and 40, which may extend at an angle of approximately 45% relative to the side members 30 and 32. The cutting block members 38 and 40 meet at the apex 41 of the cutting block. If the cutting block members 38 and 40 extend at an angle of 45° relative to the side members, then the apex angle will be 90°. It is obvious to one of ordinary skill in the art that the apex angle need not be 90°, but may be in the range 30°–150°. Thus, the angle between a cutting block member and corresponding side member may vary between 15° and 75°. The side members 30 and 32 are respectively provided with bores 48 and 48' for receiving the rivets 50 and 50'.

It is to be understood that in the preferred embodiment, all of the elements of part 14 are integrally connected to form a one-piece part.

Part 12, as shown in FIG. 5, comprises a ring 18 with a finger hole, the ring being connected to arm 22, which arm is in turn connected to crosspiece 28. The crosspiece 28 extends in a direction transverse to arm 22. In the preferred embodiment, crosspieces 26 and 28 are band-like in form and are mutually perpendicular. Crosspiece 28 is respectively connected at its ends to side members 34 and 36. The ends of side members 34 and 36 remote from crosspiece 28 are in turn connected to cutting blades 42 and 44, which also extend at an angle of approximately 45° for the embodiment shown in FIGS. 1–6, but which may range between 15° and 75° relative to side members 34 and 36. As can be seen clearly in FIG. 3, when the scissors are fully closed, the cutting blades 42 and 44 are almost, but not quite parallel to the corresponding cutting block members 38 and 40. In the closed position, only the apex of the cutting block is in contact with the respective cutting blades. The side members 34 and 36 are respectively provided with bores 49 and 49' for receiving the rivets 50 and 50' so that side members 34 and 36 are pivotably mounted on the rivets. In contrast, side members 30 and 32 are fixedly connected to rivets 50 and 50'.

As can be seen in FIG. 3, cutting blades 42 and 44 cross each other at the tips thereof. Cutting blade 44 has a notch 46 formed in its tip. The tip of cutting blade 42 extends across and through the notch. The outer lower edges of the cutting block members 38 and 40 are honed and cooperate with the corresponding honed inner upper edges of the cutting blades 42 and 44. These edges constitute the cutting edges. As the arms 20 and 22 are squeezed toward each other, the scissors move from the open to the closed position. As the scissors make the transition from the open to the fully closed position, the point of contact of the cutting edge of each cutting block member with the cutting edge of the corresponding cutting blade moves from the area adjacent to the corresponding side members to the area of the apex 41 of the cutting block. This point of contact will hereinafter be referred to as the cutting point. The cutting point for cutting block member 40 and cutting blade 44 reaches the apex 41 of the cutting block before the cutting point of cutting block member 38 and cutting blade 42 reaches the apex. This is due to the fact that the cutting edges of cutting blades 42 and 44 are not symmetrically arranged relative to the cutting block. This asymmetry is best seen in FIG. 6.

Figure 6:
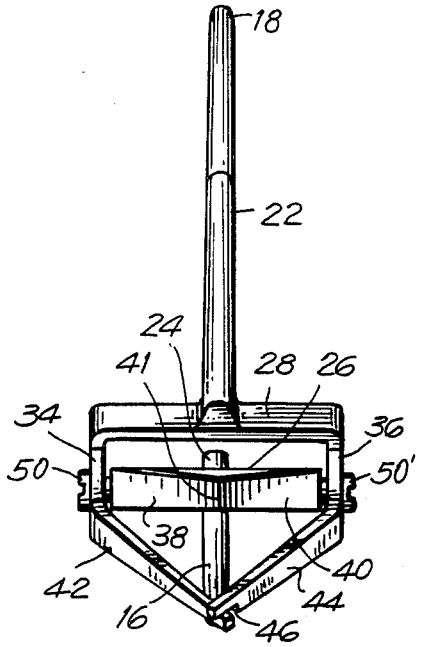
FIG. 6 is an end view of the scissors in the open position.

FIG. 6 is an end view of the scissors wherein the lower planar surface of the cutting block is perpendicular to the plane of the page. The arm 22 is at an angle of about 45% relative to arm 20. As can be seen in FIG. 6, the upper surface of the cutting block is not planar. The height of each cutting block varies linearly from the apex to the vicinity of the connected side member, with the minimum height being at the apex of the cutting block. However, it is obvious to those of ordinary skill in the art that the upper surface of the cutting block could be parallel to the lower surface; however, this would entail a waste of material since the added material serves no useful function. The asymmetry of the cutting blades 42 and 44 is also clearly visible in FIG. 6. The cutting edge of blade 42 and the cutting edge of blade 44 are at different angles relative to the lower planar surface of the cutting block. The result is that the apex of the cutting block first engages the cutting edge of blade 44 and then engages the cutting edge of blade 42. This is a consequence of the fact that the portion of the cutting edge of blade 42 which engages the apex of cutting block during snipping, i.e. closure of the scissors, is disposed directly below (as seen in the end view of FIG. 6) the portion of the cutting edge of blade 44 which engages the apex.

Figure 7:
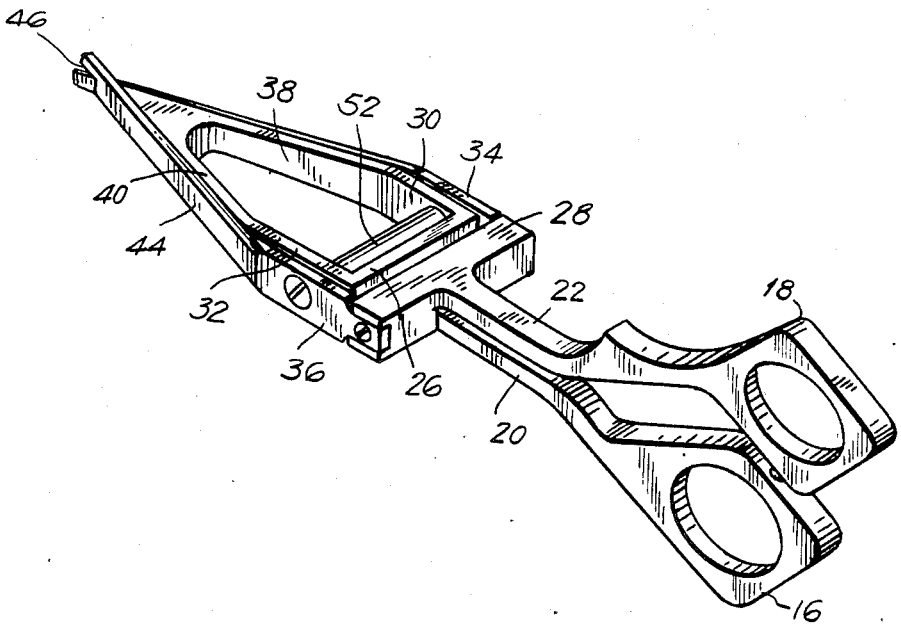
FIG. 7 is a perspective view of another preferred embodiment of the invention having an apex angle less than that of the embodiment of FIGS. 1–6.

FIG. 7 is a perspective view of another preferred embodiment of the invention wherein the apex angle is less than 90°. This embodiment also differs from the embodiment of FIGS. 1–6 in that a single pin 52 is provided for pivotably coupling parts 12 and 14. Pin 52 comprises a cylinder of predetermined diameter and two smaller end cylinders integrally connected thereto having a diameter less than the predetermined diameters. Since members 34 and 36 of part 12 and side members 30 and 32 of part 14 have respective bores in which the opposing ends of pin 52 are inserted. A further difference is that side members 34 and 36 are not integrally connected to crosspiece 28.

The foregoing description of the preferred embodiment is presented for illustrative purposes only and is not intended to limit the scope of the invention as defined in the appended claims. Modifications may be readily effected by one having ordinary skill in the art without departing from the spirit and scope of the inventive concept herein disclosed.

What is claimed is:

1. Scissors for cutting a V shape, and comprising first and second parts pivotably coupled for relative rotation about an axis by coupling means, said first part comprising:

(a) first means for receiving a digit;

(b) first cutting means having first and second cutting edges formed thereon; and (c) first support means for rigidly connecting said first means for receiving a digit to said first cutting means, and said second part comprising:

(a) second means for receiving a digit;

(b) second cutting means having first and second cutting edges formed thereon; and (c) second support means for rigidly connecting said second means for receiving a digit to said second cutting means, said first and second support means being pivotably coupled, wherein said first and second cutting means are arranged such that said and second cutting edges of said first cutting means respectively engage said first and second cutting edges of said second cutting means during the relative rotation of said first and second parts in a closing direction, said first cutting edges performing a first cut and said second cutting edges performing a second cut, said first and second cuts defining a V shape, said first cutting edges and said second cutting edges being disposed whereby said first and second cuts are terminated at different times during said relative rotation of said first and second parts in a closing direction.

2. Scissors for cutting a V shape, comprising first and second parts pivotably coupled for relative rotation about an axis by coupling means, said first part comprising:

(a) a first ring having a finger hole formed therein;

(b) a first support means connected to said first ring; and (c) first and second cutting block members repsectively connected to first and second portions of said first support means, each of said cutting block members having a cutting edge, the ends of said first and second cutting block members remote from said first support means being connected to form an apex, and said cutting edges of said first and second cutting block members lying in a plane, said second part comprising:

(a) a second ring having a finger hole formed therein;

(b) a second support means connected to said second ring and pivotably coupled to said first support means by said coupling means; and (c) first and second cutting blades respectively connected to first and second portions of said second support means, each of said cutting blades having a cutting edge, said first and second cutting blades being arranged such that the cutting edges of said first and second cutting blades respectively engage the cutting edges of said cutting block members during the relative rotation of said first and second parts which causes said rings to approach each other, wherein said cutting blades are arranged such that the angle between the cutting edge of said first cutting blade and the plane defined by the cutting edges of said cutting block members is less than the angle between the cutting edge of said second cutting blade and said plane during simultaneous engagement of said cutting edges.

3. The scissors as defined in claim 2, wherein said first cutting blade has a notch formed in the end remote from said second support means, the corresponding end of said second cutting blade passing through said notch.

4. The scissors as defined in claim 2, further comprising a projection integrally formed on one of said support means and arranged to contact the other of said support means and prevent said first and second support means from further approaching each other, said contact defining a closed state of said scissors.

5. Scissors for cutting a V shape, comprising first and second parts pivotably coupled for relative rotation about an axis by coupling means, said first part comprising:

(a) a first ring having a finger hole formed therein;

(b) a first support means connected to said first ring; and (c) first and second cutting block members respectively connected to first and second portions of said first support means, each of said cutting block members having a cutting edge, the ends of said first and second cutting block members remote from said first support means being connected to form an apex, and said cutting edges of said first and second cutting block members lying in a plane, said second part comprising:

(a) a second ring having a finger hole formed therein;

(b) a second support means connected to said second ring and pivotably coupled to said first support means by said coupling means; and (c) first and second cutting blades respectively connected to first and second portions of said second support means, each of said cutting blades having a cutting edge, said first and second cutting blades being arranged such that the cutting edges of said first and second cutting blades respectively engage the cutting edges of said cutting block members during the relative rotation of said first and second parts which causes said rings to approach each other, wherein the cutting edges of said cutting block members meet at a point along said apex, and said cutting blades are arranged such that said apex point engages the cutting edges of said first and second cutting blades at different angles in the relative rotation of said first and second parts.

6. The scissors as defined in claim 5, wherein said first cutting blade has a notch formed in the end remote from said second support means, the corresponding end of said second cutting blade passing through said notch.

7. The scissors as defined in claim 5, further comprising a projection integrally formed on one of said support means and arranged to contact the other of said support means and prevent said first and second support means from further approaching each other, said contact defining a closed state of said scissors.

* * * * *